US012310548B2

(12) United States Patent
Hahn et al.

(10) Patent No.: US 12,310,548 B2
(45) Date of Patent: May 27, 2025

(54) CLEANING SYSTEM COMPRISING A BASE UNIT AND AT LEAST ONE ACCESSORY DEVICE

(71) Applicant: Vorwerk & Co. Interholding GmbH, Wuppertal (DE)

(72) Inventors: Frederic Hahn, Langenfeld (DE); Richard Hellwig, Nordkirchen (DE); Artur Gaida, Burscheid (DE)

(73) Assignee: Vorwerk & Co. Interholding GmbH, Wuppertal (DE)

( * ) Notice: Subject to any disclaimer, the term of this patent is extended or adjusted under 35 U.S.C. 154(b) by 391 days.

(21) Appl. No.: 18/087,868

(22) Filed: Dec. 23, 2022

(65) Prior Publication Data

US 2023/0200610 A1 Jun. 29, 2023

(30) Foreign Application Priority Data

Dec. 29, 2021 (EP) ..... 21218183

(51) Int. Cl.
*A47L 9/28* (2006.01)

(52) U.S. Cl.
CPC ..... *A47L 9/2805* (2013.01); *A47L 9/2836* (2013.01); *A47L 9/2894* (2013.01)

(58) Field of Classification Search
CPC ..... A47L 9/2805; A47L 9/2836; A47L 9/2894
See application file for complete search history.

(56) References Cited

U.S. PATENT DOCUMENTS

2010/0281646 A1* 11/2010 Fujiwara ..... A47L 9/2889 15/319
2023/0018167 A1* 1/2023 O'Shaughnessy ..... A47L 9/22

FOREIGN PATENT DOCUMENTS

| | | | | |
|---|---|---|---|---|
| DE | 203 09 075 U1 | | 10/2004 | |
| DE | 102012105965 A1 | * | 1/2014 | ..... A47L 9/2805 |
| DE | 102015118643 A1 | * | 5/2017 | ..... A47L 5/28 |
| DE | 102018115669 A1 | * | 1/2020 | ..... A47L 5/24 |
| EP | 3162263 A1 | * | 5/2017 | ..... A47L 5/28 |
| EP | 3725201 A1 | * | 10/2020 | ..... A47L 5/225 |
| ES | 2874703 A1 | * | 11/2021 | |
| JP | 2001157655 A | * | 6/2001 | |

* cited by examiner

*Primary Examiner* — Marc Carlson
(74) *Attorney, Agent, or Firm* — Collard & Roe, P.C.

(57) ABSTRACT

A cleaning system has a base unit and a separably connected accessory device. The base unit has a detection device for detecting the type of accessory device connected to the base unit, a base memory and a control device for controlling an operating activity of the base unit and/or the accessory device depending on the type of connected accessory device. The accessory device has a configuration memory, in which configuration data for configuring the base unit and/or the accessory device for an operation of the cleaning system is stored. The control device of the base unit reads the configuration data stored in the configuration memory and stores this configuration data centrally in the base memory. The control device accesses the configuration data stored in the base memory for an operation of the cleaning system and adjusts the base unit and/or the accessory device based on the configuration data.

11 Claims, 2 Drawing Sheets

CLEANING SYSTEM COMPRISING A BASE UNIT AND AT LEAST ONE ACCESSORY DEVICE

CROSS REFERENCE TO RELATED APPLICATIONS

Applicant claims priority under 35 U.S.C. § 119 of European Application No. 21218183.8 filed Dec. 29, 2021, the disclosure of which is incorporated by reference.

BACKGROUND OF THE INVENTION

1. Field of the Invention

The invention pertains to a cleaning system comprising a base unit and at least one accessory device for being separably connected to the base unit, wherein the base unit has a detection device for detecting the type of accessory device currently connected to the base unit, a base memory and a control device for controlling an operating activity of the base unit and/or the accessory device in dependence on the type of the connected accessory device.

2. Description of the Related Art

Base units such as cleaning appliances with accessory devices are known from the prior art. For example, the accessory device is a carpet brush or a hard floor attachment for a vacuum cleaner or a wet cleaning attachment for a wet cleaning appliance.

In order to connect the accessory device to the base unit, the base unit has a connecting region, on which the accessory device is snap-locked, attached or connected in any other way. In the case of a vacuum cleaner, for example, a suction channel section is formed in the connecting region in order to connect a corresponding suction channel section of the accessory device thereto such that suction air can be conveyed from a surface to be cleaned to a fan through the accessory device and a filter chamber of the base unit.

The base unit may be realized, for example, in the form of an upright vacuum cleaner or in the form of a unit that is separated from the accessory device by a hose and can be moved separately.

The base units known from the prior art usually have a selection device, by means of which a user can select an operating mode, e.g. with respect to different power stages of a fan of the base unit and/or with respect to different adjustments of the accessory device. For example, the accessory device can be optimized for a certain floor type with respect to bristle elements and/or sealing elements such that it is possible, for example, to predominantly clean carpeted floors or hard floors in an optimal manner.

It is furthermore known to transmit information on a type of the accessory device to the base unit in order to vary an operating parameter of the base unit. For example, DE 203 09 075 U1 discloses a transmission of information on the type of the accessory device to the base unit, whereupon the suction power of the base unit can be adjusted in accordance with the respective accessory device. A microcontroller of the base unit receives the information on the type of the accessory device, evaluates this information and subsequently controls the operating parameter of the base unit.

In this context, it is disadvantageous that the evaluation is based on allocations that are stored in the base unit and associate a certain type of accessory device with certain operating parameters to be adjusted. It is therefore impossible to control unknown accessory devices.

Based on this prior art, the invention aims to allow an interaction between the base unit and an accessory device that is still unknown to the base unit.

SUMMARY OF THE INVENTION

In order to attain the above-defined objective, it is proposed that the accessory device has a configuration memory, in which configuration data for configuring the base unit and/or the accessory device for an operation of the cleaning system is stored, wherein the control device of the base unit is designed for storing the configuration data stored in the configuration memory of the accessory device centrally in the base memory, and wherein the control device is designed for accessing the configuration data stored in the base memory for an operation of the cleaning system and for adjusting the base unit and/or the accessory device based on the configuration data.

According to the invention, the configuration data required for the operation of the cleaning system is now directly stored in the configuration memory of the accessory device and can be transferred to the base memory of the base unit in identical form. The configuration data may either concern only the base unit, only the accessory device or both the base unit and the accessory device. The invention eliminates the need to carry out a software change in the control device of the base unit when a new accessory device is used, wherein the configuration data stored in the base memory is in fact merely changed or supplemented. Consequently, a new accessory device already contains configuration data in its own configuration memory and this configuration data can be read out by the control device of the base unit in the course of a learning process. The configuration data read out or received by the control device is then stored in the separate base memory of the base unit. The control device of the base unit accesses the configuration data in order to control an operation of the respective accessory device. This may also include the transmission of the configuration data from the base unit back to the accessory device for control purposes. In this context, the term base memory of the base unit does not necessarily refer to a single memory. In fact, the base memory may consist of a plurality of individual partial memories that store information in a volatile or non-volatile manner. All in all, the invention makes it possible to also use the base unit of the cleaning system with accessory devices that were not even introduced on the market or in development at the time the base unit was manufactured. If the manufacturer of the base unit develops a new accessory device after the base unit has been introduced on the market, the configuration data of this new accessory device is stored in a separate configuration memory of the accessory device and can be transferred to the base unit when the accessory device is connected to the base unit for the first time. Due to the subsequent central storage of the configuration data in the base memory of the base unit, the information on the system behavior of the cleaning system is available centrally at a single memory location such that required configuration data can be distributed to all participants of the cleaning system at the time of a system start, i.e. a start of the base unit and an accessory device connected thereto. Changes or supplements of the configuration data take place at the central memory location in the base unit and are also available to the accessory devices.

It is proposed that a configuration datum contains a configuration parameter for the base unit, as well as a configuration parameter for the accessory device. Consequently, configuration parameters to be adjusted on the base unit, as well as on the accessory device, are stored in the accessory device. It is no longer necessary to carry out configuration adjustments on the base unit on the one hand and on the accessory device on the other hand. In fact, the configuration datum may be a set of characters that contain configuration parameters for the base unit on the one hand, and configuration parameters for the accessory device on the other hand. The control device of the base unit can read and evaluate this character set and then separate the character set into corresponding portions for the base unit and the accessory device. However, a configuration datum may alternatively also contain a configuration parameter for only the base unit or for only the accessory device if the other system components should not be controlled by the configuration datum. If a configuration datum contains configuration parameters for the base unit and for the accessory device, the portion of the configuration datum relevant for the accessory device is extracted and transmitted to the accessory device, particularly in the form of wireless communication via corresponding interfaces of the base unit and the accessory device.

The accessory device may have an accessory control device, which is designed for detecting an accessory element that is connected to the accessory device and defines the type of the accessory device, as well as for transmitting configuration data corresponding to the type of the accessory device to the control device of the base unit or for making this configuration data available in the configuration memory. According to this embodiment, the accessory device is realized in such a way that it can comprise different accessory elements designed for different treatment activities. For example, the accessory device may be a so-called electric brush that can accommodate different motor-driven brush elements. For example, the electric brush may serve for a conventional vacuum cleaning process, during which an accessory element in the form of a brush roller is driven in a rotating manner while a fan of the base unit is at the same time operated and draws suction air into the accessory device past the brush roller and then into the base unit. The accessory device for a second treatment activity may be realized in the form of a special carpet cleaning device that has an accessory element for incorporating carpet cleaning medium into a carpeted floor. The fan of the base unit remains switched off during the treatment activity "carpet cleaning" such that the carpet cleaning medium applied on the carpet is not immediately vacuumed off again, but rather remains in the carpeted floor in order to fulfill its function therein. After the incorporation of the carpet cleaning medium by means of the accessory element is completed, the user can switch off the base unit and replace the previously used accessory element with a conventional brush roller, which is then once again used in the course of a conventional vacuum cleaning process in order to vacuum the carpet cleaning medium out of the carpeted floor. The separate accessory control device of the accessory device is designed for detecting the type of accessory element currently connected to the accessory device. In the aforementioned instance, the accessory control device therefore is designed for detecting whether the brush roller for the vacuum cleaning process or a special carpet cleaning brush for incorporating carpet cleaning medium into the carpeted floor is used. The accessory element may have a unique code in order to positively identify the accessory element by means of the accessory control device. For example, the code is an optical code that is arranged on a surface of the accessory element and can be read out by means of a corresponding reader of the accessory control device. Naturally, other codes such as shape coding, electromagnetic coding or the like may also be considered as alternatives to an optical code. Corresponding accessory device configuration data for the respective code is stored in the configuration memory of the accessory device. This configuration data either can be transmitted to the control device of the base unit by the accessory control device or read out by the control device of the base unit.

It is furthermore proposed that the configuration datum contains a configuration parameter that is selected from the following group: suction power of a fan, power of a driving motor, rotational speed of a rotating surface treatment element, oscillation frequency of an oscillating surface treatment element, position of a flow control element, flow cross section of a flow channel, discharge rate of a liquid application device. A configuration datum basically can contain any type of physical parameter that can be respectively controlled by the control device of the base unit or an accessory control device of the accessory device. This particularly includes the power of a driving motor that can drive certain components of the cleaning system, e.g. a fan, a locomotion device, a rotating or oscillating treatment device, a mechanical adjustment device, a pump, a valve or the like. The aforementioned configuration parameters particularly refer to surface treatment appliances such as vacuum cleaners or wet wiping appliances. Appliances of this type are usually operated in one or more different modes, in which different power settings of the fan or different rotational speeds or oscillating frequencies of a treatment element are adjusted. It is also possible, for example, to change positions of flow control elements such as sealing elements on a suction mouth or the like. Furthermore, a flow cross section of a flow channel can also be narrowed or widened. An operating mode, particularly of wet cleaning appliances, may also include a certain discharge rate of a liquid application device that is suitable for applying, for example, water or cleaning additives on a surface to be cleaned or a surface treatment element.

The accessory device preferably has a biunique identification code, wherein the detection device of the base unit is designed for detecting the identification code and for transmitting the identification code to the control device of the base unit, and wherein the control device is designed for storing the configuration data together with the detected identification code in the base memory and/or for retrieving configuration data stored for the detected identification code in the base memory. The control device of the base unit identifies an accessory device based on the identification code when the accessory device is connected to the base unit. A learning process is initially carried out if the accessory device is connected to the base unit for the first time. The identification code and the configuration data are read out of the accessory device and stored in the base memory in this learning process. The accessory device identifies itself to the control device of the base unit by means of the biunique identification code, which is only assigned to a single accessory device. However, a certain type of accessory devices that are designed identical to one another may alternatively also have a common identification code. The identification code may be integrated into a character set, which at the same time also contains one or more configuration data for the base unit and/or the accessory device, in the form of an integral component. The identification code on the one hand serves for the identification of the accessory device on the base unit and on the other hand for the allocation of the configuration data belonging to the respective accessory device in the base memory. The configuration data is stored in the base memory in connection with the identification code and can subsequently be retrieved again by the base memory once the identification code is known. When a certain accessory device is reconnected to the base unit, the control device of the base unit searches the stored configuration data for at least one configuration datum that is stored for the identification code. The detection device of the base unit, which serves for detecting the type of accessory device or for detecting the identity of a certain accessory device, may be realized, for example, in the form of an optical detection device that is suitable for reading an optical code of the accessory device, e.g. in the form of a barcode, a QR code or another known optical code. In a particularly simple instance, the detection device may furthermore also be realized in the form of a receiver that can receive electromagnetic signals from a corresponding transmitter of the accessory device. The accessory device and the base unit particularly may have corresponding wireless communication interfaces such as WLAN modules, BLUETOOTH® modules or ZIGBEE® modules with corresponding transmitters and receivers. The communication interfaces may alternatively also be realized in a wire-bound manner, e.g. in the form of device connections of a bus system. Data communication between the base unit and the accessory device then takes place for the respective identification process or import process.

It is proposed that the base memory contains a plurality of configuration tables that have a priority sequence for the configuration of the cleaning system, wherein the control device is designed for initially searching for a configuration datum in a configuration table with the highest order of priority and, in case no configuration datum is entered therein, for searching for a configuration datum in one or more configuration tables with comparatively lower order of priority in descending priority sequence. The configuration data read out of the accessory device is stored in one or more configuration tables depending on their order of priority specified by the manufacturer. The control device of the base unit accesses these configuration tables for the operation of the respective accessory device or the base unit. The configuration tables have different hierarchy levels that are scaled with a priority and read out in descending priority sequence. Consequently, the configuration table that has the highest order of priority and contains an entry for the accessory device makes available the configuration data required for the control. If no entry for the accessory device is stored in a configuration table with the highest order of priority, a search for an entry is carried out in the configuration table with the next lower order of priority.

With respect to a descending priority sequence, the configuration tables may be selected from the following group: a temporary table containing configuration data that is stored in a volatile manner and read out of the configuration memory of the accessory device by the control device, wherein said configuration data is deleted when the base unit is switched off; an individual table containing configuration data specified by a user; an update table containing configuration data that is stored in a non-volatile manner and read out of the configuration memory of the accessory device by the control device, wherein said configuration data remains stored when the base unit is switched off; a default table that is already stored in the base memory in a delivery state of the base unit by the manufacturer. Consequently, the configuration tables may in descending priority sequence be divided into a temporary table for storing merely temporary configuration data, an individual table that is individually configured by the user, an update table that permanently makes available configuration data for new accessory devices and/or a default table configured by the manufacturer. Only the default table is filled with one or more entries in a delivery state of the base unit. In this context, the default table contains at least one configuration datum for only the base unit, i.e. for an operation of the base unit without any accessory device. Furthermore, the default table may also contain one or more configuration data for combinations of the base unit and one or more accessory devices, which were already known at the time the base unit was manufactured. This configuration data serves as so-called "default data" and is stored in a non-volatile manner. The configuration data represents defaults for the base unit in the solo mode, i.e. in an operating mode without an accessory device connected thereto, or configuration data for very particular combinations of base unit and accessory device, which were already known in the delivery state of the base unit. In contrast, the temporary table contains, for example, only a temporary entry that is stored for a certain treatment process. Such a configuration datum preferably is stored in a volatile memory and only used in a certain predefined situation, e.g. for an application of the accessory device that is only used infrequently in comparison with other applications and therefore only stored in the memory temporarily. This configuration datum is deleted again each time the base unit is switched off. However, the user always has the option of using the associated application due to the fact that this configuration datum is also stored in the temporary table at least in a volatile manner. The proposed individual table can be changed by a user of the base unit. For example, the user can carry out supplements, changes and/or deletions in this individual table. Furthermore, the user preferably can view the configuration data stored in the configuration tables by means of an application installed on an external terminal, wherein the content of the individual table may be displayed to the user in an optically highlighted manner. The proposed update table contains updated configuration data. This configuration data is stored in a non-volatile manner, i.e. it is also available in the memory after the base unit has been switched off and switched on again. This update table is empty in a delivery state of the base unit by the manufacturer. The update table is only filled once the user connects a first accessory device to the base unit for the first time. At this point, the configuration data read out of the accessory device is transferred into the update table. This takes place in the course of a learning process of the accessory device on the base unit. However, a user can also update or change the configuration data stored therein.

Each configuration table of the base memory may contain configuration data for the same accessory device, for the base unit and/or for a defined combination of base unit and accessory device. The application of the stored configuration data by the control device of the base unit then takes place with consideration of the priority sequence specified by the configuration tables.

It is furthermore proposed that the control device is designed for detecting a target memory location for storing a configuration datum based on a priority code of the configuration datum and for carrying out a corresponding allocation to a configuration table defined by the priority code. For example, the configuration memory of the accessory device may contain multiple configuration data that needs to be sorted into different configuration tables. For example, an accessory device may be designed for different applications. A cleaning nozzle may carry out, for example, a dry cleaning process on the one hand and a wet cleaning process on the other hand, wherein the user predominantly carries out only a dry cleaning process and uses the wet cleaning process rather infrequently. In this case, the configuration datum for the wet cleaning process may be stored, for example, as a merely temporary adjustment in the base memory. To this end, this configuration datum is stored in the temporary table, which only contains configuration data that is stored in a volatile manner and deleted when the base unit is switched off. In contrast, the configuration datum for the application of the cleaning nozzle for a dry cleaning process is stored in the update table, which stores the data contained therein in a non-volatile manner, i.e. permanently, such that this data also remains stored when the base unit is switched off. In order to enable the control device of the base unit to correctly allocate the configuration data read out of the configuration memory of the accessory device, the respective configuration datum has a priority code that specifies the allocation to the certain configuration table. Furthermore, an accessory device may also be designed for different types of dry cleaning processes, e.g. for a conventional vacuum cleaning process and for a special carpet cleaning process, in which a carpet cleaning medium is incorporated into a carpeted floor. A thusly designed accessory device is connected to certain accessory elements that serve for carrying out the respective treatment activity. In this case, the configuration memory of the accessory device contains configuration data for the normal carpet cleaning process on the one hand and configuration data for the special carpet cleaning process on the other hand. According to another embodiment, a separate accessory control device can detect the type of accessory element currently used in the accessory device and respectively transmit the associated configuration data to the base unit or make this configuration data available for retrieval in the accessory device. The control device of the base unit then respectively reads out or receives this configuration data and, as described above, likewise uses a priority code for allocating this configuration data to a certain configuration table specified for the respective priority code.

It is furthermore proposed that the base unit has a communication interface that enables a user to access the base memory by means of an application installed on an external terminal in order to supplement and/or delete and/or change configuration data of the base unit and/or the accessory device. For example, the external terminal of the user may be a mobile terminal such as a mobile telephone or a tablet computer or alternatively a stationary computer such as a local desktop computer. The communication interface preferably is realized in the form of a wireless communication interface and uses radio technologies such as WLAN, Bluetooth or ZigBee. However, the data transmission may alternatively also take place in a wire-bound manner. The external terminal preferably has a display, on which the application makes available a graphical user interface. The configuration tables with corresponding content particularly can also be displayed thereon. This enables the user to also carry out changes, supplements and/or deletions. The changes of the user usually take place in the individual table, into which the user can individually enter configuration data for certain accessory devices. However, the user may also be able to access the temporary table and/or the update table. In contrast, the default table should be designed in such a way that it cannot be accessed by the user because this table contains a preconfiguration of the cleaning system, which was stored by the manufacturer at the time of delivery and the configuration data of which the control device accesses when needed, particularly in case of a fault.

If a configuration table contains a configuration datum that is not plausible and therefore cannot be used, the configuration datum is declared invalid by the control device of the base unit or an accessory control device of the accessory device upon unsuccessful execution. The control device subsequently carries out a search for other configuration data in the same configuration table or in the remaining configuration tables with lower order of priority. If the configuration tables, particularly the above-described temporary table and/or individual table and/or update table, do not contain an executable configuration datum, the control device of the base unit can resort to at least the configuration data contained in the default table. The control device initially can check the configuration data with respect to plausibility and executability before new configuration data of an accessory device or configuration data transmitted to the control device of the base unit by the user is ultimately allocated to a configuration table. If the configuration data is valid, it is stored in a configuration table and loaded, e.g., into a main memory of the base unit such that a treatment activity can henceforth be started. If the configuration data is invalid, it is discarded and, if applicable, replaced with other configuration data contained in one of the configuration tables.

In a delivery state of the base unit by the manufacturer, the base memory of the base unit preferably contains only configuration data for an operation of the base unit without a connected accessory device. Alternatively, the base memory of the base unit may in a delivery state of the base unit by the manufacturer contain only configuration data for an operation of the base unit without a connected accessory device and configuration data for at least one already known combination of the base unit and a certain accessory device. Consequently, the base unit is in the delivery state configured by the manufacturer of the base unit in such a way that it only contains configuration data for actually known combinations of base unit and accessory device or only configuration data for the base unit in a solo mode. Accordingly, all other configuration data required for the operation of subsequently developed accessory devices is not yet present in the base memory at the time of delivery of the base unit, but rather only made available together with the newly developed accessory device in its configuration memory. The accessory device itself therefore provides the configuration data required by the base unit for optimally operating the accessory device.

It is ultimately proposed that the control device of the base unit is designed for transmitting configuration data for configuring the accessory device, which was read out of the configuration memory of the accessory device, to a separate accessory control device of the accessory device, wherein the accessory control device is designed for subsequently adjusting the control device itself based on the configuration data received from the base unit. The control device of the base unit initially reads out all configuration data present in the configuration memory of the accessory device and then divides this configuration data into configuration data for the base unit itself and configuration data for the accessory device. The configuration data for controlling the accessory device is subsequently transmitted to the separate accessory control device of the accessory device, which then carries out corresponding adjustments of the accessory device itself. This means that the portion of the configuration data relevant for the accessory device is transmitted back to the accessory device. The accessory device subsequently checks the received configuration data for usability and correctness. The configuration data can be verified as executable if it can be executed by the accessory device. However, the accessory device can declare the configuration as invalid to the control device of the base unit if the configuration data cannot be used. If applicable, the control device of the base unit subsequently searches for valid configuration data in the configuration tables of the base memory again in response to this type of information of the accessory device. A system error of the cleaning system is output if no valid configuration datum is found, particularly also despite existing configuration data in the configuration tables.

BRIEF DESCRIPTION OF THE DRAWINGS

Other objects and features of the invention will become apparent from the following detailed description considered in connection with the accompanying drawings. It is to be understood, however, that the drawings are designed as an illustration only and not as a definition of the limits of the invention.

In the drawings.

DETAILED DESCRIPTION OF PREFERRED EMBODIMENTS

Figure 1:
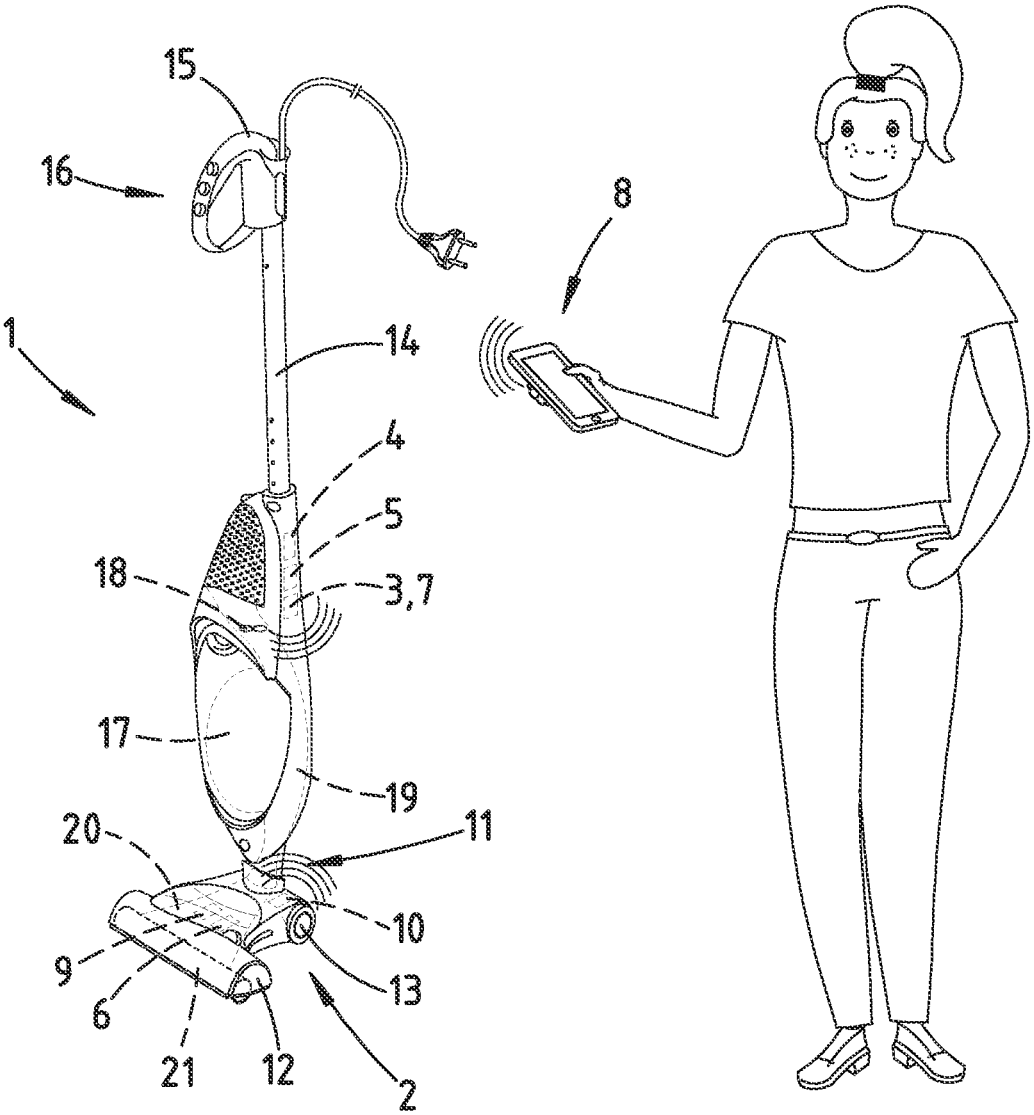
FIG. 1 shows an inventive cleaning system with a base unit and an accessory device that is separably connected to the base unit.

FIG. 1 shows a potential exemplary embodiment of an inventive system comprising a base unit 1 and an accessory device 2 that is separably connected to the base unit 1. The base unit 1 has a connection interface 11, on which the accessory device 2 can be separably arranged. The cleaning system may furthermore comprise other accessory devices 2 that are not illustrated in the figures. The accessory devices 2 may be designed identically or differently.

In this example, the base unit 1 is realized in the form of a conventional household vacuum cleaner. The base unit 1 conventionally comprises a dust chamber 17 and a fan 18, which are fluidically connected to one another via an air flow channel 19. The air flow channel 19 leads into the connection interface 11, at which it is connected to a corresponding air flow channel 20 of the accessory device 2. A shaft 14 with a handle 15 is also located on the base unit 3. The shaft 14 preferably is designed in a telescoping manner such that a user of the base unit 1 can advantageously adapt the length of the shaft 14 to his body size. The handle 15 enables the user to guide the base unit 1 over a surface to be cleaned, wherein the base unit 1 usually is moved successively back and forth over the surface to be cleaned. An input device 16 with multiple input buttons is located on the handle 15, wherein said input buttons enable the user to transmit entries to a control device 5 of the base unit 1. For example, the entry may be an operational specification for a treatment activity of the base unit 1 such as a certain operating mode with a certain power level of the fan 18, which the user can select from three different power levels in this example. The base unit 1 also has a communication interface 7 for the wireless communication with a corresponding communication interface 10 of the accessory device 2. In this example, the communication interface 7 of the base unit 1 simultaneously serves as a detection device 3, by means of which the base unit 1 can detect the type of an accessory device 2 currently connected to the base unit 1. The corresponding communication interfaces 7, 10 of the base unit 1 and the accessory device 2 are realized, for example, in the form of wireless communications interfaces 7, 10, e.g. in the form of WLAN modules, BLUETOOTH® modules, ZIGBEE® modules or the like. A wire-bound communication between the base unit 1 and the accessory device 2 is alternatively also possible, e.g. by means of corresponding connections of an internal bus system. The base unit 1 furthermore is provided with a base memory 4, in which configuration data for configuring the base unit 1 and/or the accessory device 2 is stored. This is described in greater detail below. A user of the cleaning system can access the base memory 4 by means of an external terminal 8, which in this example is a mobile telephone. An application is installed on the external terminal 8 and allows data communication with the base unit 1 such that the user can read, supplement, change or delete configuration data stored in the base memory 4.

In the exemplary embodiment shown, the accessory device 2 has a suction nozzle 12 and a surface treatment element 21 for treating a surface to be cleaned. In this example, the surface treatment element 21 is a cleaning roller that rotates about an essentially horizontal axis of rotation and may be provided, for example, with cleaning bristles in order to intensify its effect on the surface to be cleaned. Wheels 13 arranged on the accessory device 2 make it possible to move the base unit 1 along with the accessory device 2 over the surface to be cleaned with particularly low friction. In this example, the accessory device 2 has its own accessory control device 9 that checks operational specifications transmitted by the control device 5 of the base unit 1 and converts these operational specifications into its own control commands. However, it would alternatively also be possible that the control device 5 of the base unit 1 already transmits executable control commands to the accessory control device 9 of the accessory device 2 such that the accessory control device 9 merely has to implement the control commands, e.g. by adjusting corresponding configuration parameters of the accessory device 2. The accessory control device 9 of the accessory device 2 can also transmit configuration data to the base unit 1. The accessory device 2 furthermore has a configuration memory 6 that contains configuration data for the configuration of the base unit 1 and/or for the configuration of the accessory device 2.

Figure 2:
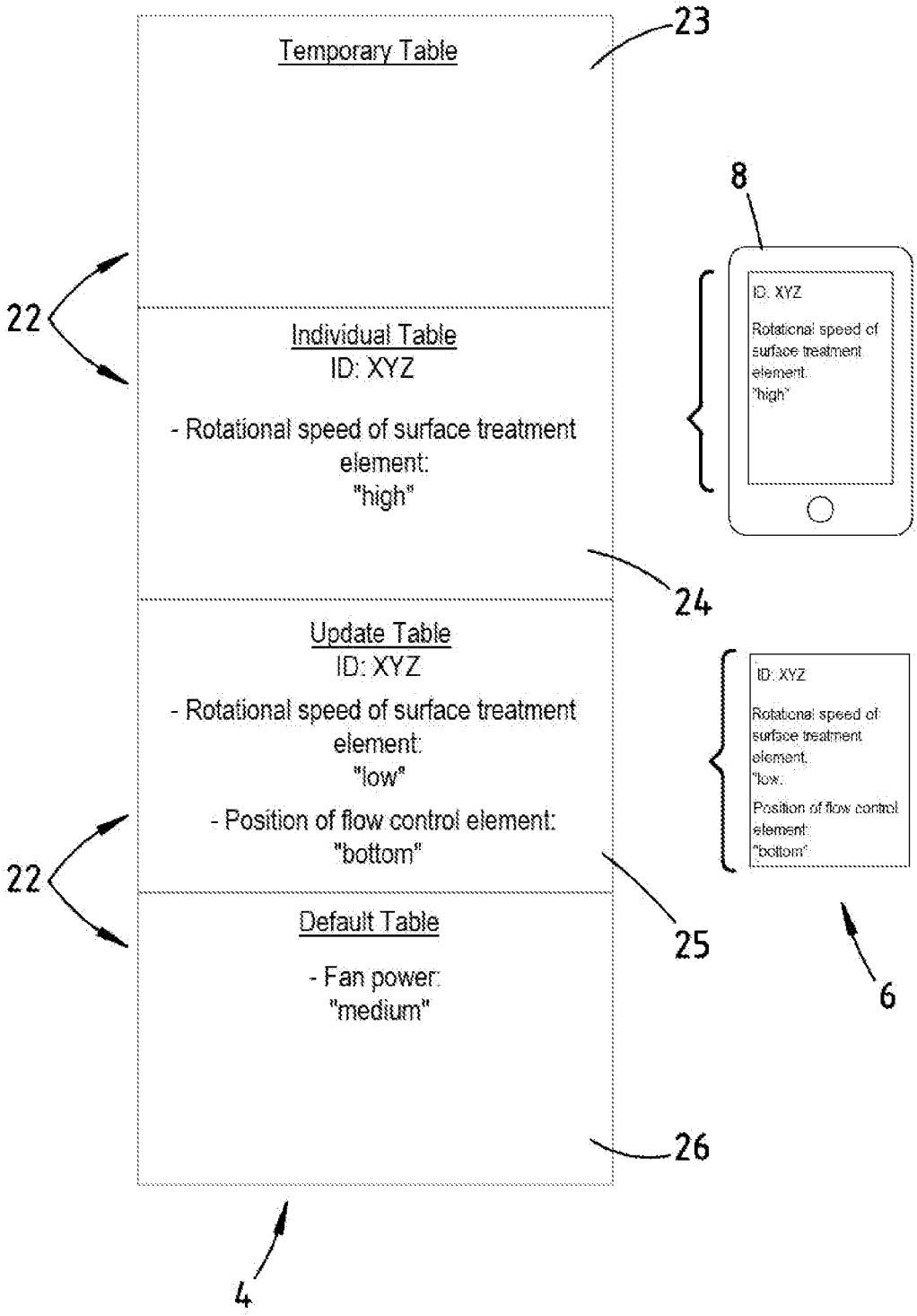
FIG. 2 shows a transmission of configuration data from an accessory device and an external terminal to the base unit.

According to FIG. 2, the base memory 4 of the base unit 1 contains a plurality of configuration tables 22, in which configuration data for the base unit 1 and for one or more accessory devices 2 of the cleaning system can be stored. In this example, the configuration tables 22 comprise a temporary table 23, an individual table 24, an update table 25 and a default table 26. The configuration tables 22 have different orders of priority such that the control device 5 of the base unit 1 initially searches for configuration data in the temporary table 23, then—in case the temporary table 23 does not contain any configuration data for the base unit 1 or the accessory device 2—in the individual table 24, then optionally in the update table 25 and then optionally in the default table 26 in order to carry out a treatment activity. The default table 26 is the only configuration table 22 of the plurality of configuration tables 22, which already contains configuration data for the base unit 1 in the delivery state of the base unit 1. Furthermore, configuration data for combinations of the base unit 1 and an accessory device 2, which were already known at the time of delivery of the base unit 1 by the manufacturer, may be stored in the default table 26. According to the embodiment described herein, the user cannot access the configuration data of the default table 26 or at least not carry out any supplements, changes or deletions thereof, e.g. by means of the external terminal 8. If applicable, the external terminal 8 may merely have permission to read the default table 26. The configuration data is permanently stored in the default table 26, i.e. it is still available after the base unit 1 has been switched off and switched on again.

The update table 25, which has a higher order of priority than the default table 26, contains configuration data that the control device 5 of the base unit 1 has read out of the configuration memory 6 of an accessory device 2 connected to the base unit 1 or received from the accessory control device 9. The configuration data, which in this example is stored in the configuration memory 6 of the accessory device 2, refers at least to the currently connected accessory device 2 that has identified itself to the control device 5 of the base unit 1 by means of an identification code, which in this example is "XYZ." Furthermore, the configuration data for the accessory device 2 described herein contains, for example, a configuration parameter for a rotational speed of the surface treatment element 21 on the one hand and for a position of a flow control element located in the air flow channel 20 of the accessory device 2 on the other hand. The configuration data stored in the configuration memory 6 of the accessory device 2 may comprise configuration data for the base unit 1, as well as configuration data for the accessory device 2. In this example, the configuration memory 6 of the accessory device 2 only contains configuration data for the accessory device 2.

The individual table 24 contains configuration data, which a user defines individually and transmits to the base memory 4 of the base unit 1 by means of the external terminal 8. In the present exemplary embodiment, the user defines a rotational speed for the surface treatment element 21, which differs from the configuration data in the update table 25, for the accessory device 2 with the ID "XYZ." Since the individual table 24 has a higher order of priority than the update table 25 for the control of the accessory device 2, the user therefore can override the configuration data contained in the update table 25.

The temporary table 23 is empty in the exemplary embodiment shown. According to a different embodiment of the invention, however, this temporary table could contain configuration data for an application of the cleaning system that is used rather infrequently. For example, the accessory device 2 may be designed for different cleaning activities, e.g. for a conventional vacuum cleaning process on the one hand and for a less frequently used special carpet cleaning process, in which cleaning medium is incorporated into the fibers of the carpeted floor, on the other hand. During this carpet cleaning process, it is proposed that the fan 18 of the base unit 1 remains switched off while the cleaning medium is applied on and incorporated into the fibers of the carpeted floor such that the cleaning medium is not immediately vacuumed off again, but rather has time to take effect. Since the configuration data for the special carpet cleaning process therefore is only required infrequently, this configuration data is only stored in the temporary table 23 when necessary. This configuration data is subsequently deleted again from the temporary table 23 when the user switches off the base unit 1. The free storage volume of the base memory 4 can be optimized due to the deletion of configuration data that is merely stored temporarily.

In order to provide the control device 5 of the base unit 1 with information on which configuration data needs to be stored in which configuration table 22, the configuration memory 6 of the accessory device 2 contains allocating information for each stored configuration datum, wherein said allocating information indicates a target memory location for the respective configuration datum. Such allocating information therefore simultaneously serves as priority code for the application of the stored configuration datum because the allocation to a certain configuration table 22 also decides which configuration data is retrieved and used by the control device 5 of the base unit 1. In addition, the configuration memory 6 of the accessory device 2 preferably contains only configuration data that corresponds to a current design of the accessory device 2. In the aforementioned instance of an accessory device 2 that can be used for a conventional vacuum cleaning mode and a special carpet cleaning mode, the accessory control device 9 of the accessory device 2 initially determines which accessory element is inserted into the accessory device 2. For example, the accessory element may be a conventional bristle roller or a special brush for incorporating cleaning medium into the carpeted floor. The accessory control device 9 initially determines which accessory element is currently connected to the accessory device 2 based on an individual code of the accessory element and then stores the corresponding configuration data in the configuration memory 6. Furthermore, configuration data for different operating modes, which the user can select manually, e.g. by means of the input device 16, may be independently stored in the configuration tables 22.

The invention within the scope of the exemplary embodiment described herein is realized in such a way that the manufacturer of the cleaning system initially preconfigures the base unit 1 such that the default table 26 contains a configuration datum or multiple configuration data. This configuration data only serves for the operation of the base unit 1 by itself, i.e. without an accessory device 2 connected to the base unit 1. The configuration data of the default table 26 contains a specification for the power of the fan 18. This fan power should be a fan power that is defined as "medium." For example, the definition of the parameter range "medium" is likewise stored in the base memory 4 of the base unit 1. It is alternatively also possible that concrete values for the configuration parameters are respectively indicated in the default table 26 or in the remaining configuration tables 22.

When a user connects the acquired base unit 1 to an accessory device 2, the detection device 3 of the base unit 1 detects that the accessory device 2 was connected to the connection interface 11. The control device 5 of the base unit 1 subsequently retrieves configuration data for the accessory device 2 from the configuration memory 6 of the accessory device 2 via the corresponding communication interfaces 7, 10 of the base unit 1 and the accessory device 2. This may take place in the course of an information request of the control device 5 of the base unit 1 to the accessory device 2, whereupon the accessory device 2 transmits the data contained in its configuration memory 6 to the control device 5 of the base unit 1. The data stored in the configuration memory 6 contains among other things the identification code "XYZ" of the accessory device 2 and the corresponding configuration data. Once the control device 5 of the base unit 1 has acquired the identification code, it would also be possible that it initially only checks if the configuration tables 22 of the base memory 4 already contain configuration data for the accessory device 2 with this identification code. If this is the case, the configuration data for this accessory device 2 preferably is retrieved from the already existing configuration tables 22.

However, it would alternatively also be possible that the control device 5 of the base unit 1 reads the configuration data stored in the configuration memory 6 of the accessory device 2 and inserts this configuration data into the configuration tables 22. The control device 5 of the base unit 1 also proceeds in this way if the control device 5 determines that the accessory device 2 is not yet known, i.e. that no configuration data at all for an accessory device 2 with the identification code "XYZ" was previously stored in the configuration tables 22. An import process is initially carried out in this case, wherein the configuration data of the accessory device 2 is transferred from the configuration memory 6 of the accessory device 2 into the base memory 4 of the base unit 1 during this import process. A priority code is optionally assigned to each configuration datum and indicates in which of the plurality of configuration tables 22 the respective configuration datum needs to be stored. The configuration data stored in the configuration memory 6 may on the one hand be configuration data for the base unit 1 itself or on the other hand configuration data for the accessory device 2. The control device 5 of the base unit 1 initially retrieves all configuration data and then divides it into configuration data for the base unit 1 and configuration data for the accessory device 2. In addition, each configuration datum is stored in a certain configuration table 22, namely either in the update table 25 or in the temporary table 23 in this case. According to the present exemplary embodiment, only configuration data for infrequently used applications of the accessory device 2 is stored in the temporary table 23. Such configuration data is not present in this case. Consequently, the configuration data of the accessory device 2 is entered into the update table 25.

According to the embodiment described herein, the user of the cleaning system also accesses the configuration data stored in the configuration tables 22 by means of his external terminal 8 and respectively carries out changes or supplements. For example, the user can store preferred configuration data to be applied during the use of the accessory device 2 in the individual table 24. For example, such a configuration datum may be a rotational speed of the surface treatment element 21, which deviates from the specification of the manufacturer stored in the update table 25. The user specification is then used during the operation of the accessory device 2 because the individual table 24 has a higher order of priority than the update table 25. Furthermore, the control device 5 of the base unit 1 may optionally check the configuration data received from the configuration memory 6 of the accessory device 2 with respect to its plausibility, i.e. its usability for controlling the base unit 1. The configuration data is not stored in the configuration table 22 if the control device 5 determines that it cannot be used. If the configuration data is valid, it is entered into the configuration tables 22 and optionally loaded into a main memory of the base unit 1 in order to be available for the treatment process.

The portions of the configuration data relevant for the accessory device 2 are transmitted to a computing means of the accessory device 2. The computing means then checks if the configuration data can be used for the accessory device 2. If the data is valid, the configuration is acknowledged and a surface treatment can be started. If the configuration data is not valid, the computing means of the accessory device 2 declares it invalid and transmits corresponding information to the control device 5 of the base unit 1. Subsequently, the control device 5 can once again search for configuration data for the accessory device 2, particularly in the other configuration tables 22, wherein the configuration tables 22 are searched in the defined priority sequence. In this case, the search takes place in the sequence temporary table 23, individual table 24, update table 25, default table 26. If no valid configuration datum can be retrieved from all configuration tables 22 collectively, a system error is defined and the user is informed accordingly, e.g. by means of the external terminal 8. The user then has the option of respectively transmitting self-formulated configuration data to the control device 5 of the base unit 1 or entering this configuration data into the individual table 24.

LIST OF REFERENCE SYMBOLS

1 Base unit
2 Accessory device
3 Detection device
4 Base memory
5 Control device
6 Configuration memory
7 Communication interface
8 External terminal
9 Accessory control device
10 Communication interface
11 Connection interface
12 Suction nozzle
13 Wheel
14 Shaft
15 Handle
16 Input device
17 Dust chamber
18 Fan
19 Air flow channel
20 Air flow channel
21 Surface treatment element
22 Configuration table
23 Temporary table
24 Individual table
25 Update table
26 Default table

What is claimed is:

1. A cleaning system comprising:

a base unit, and at least one accessory device configured for being separably connected to the base unit, wherein the base unit comprises:

a detection device configured for detecting the type of accessory device currently connected to the base unit, a base memory and a control device configured for controlling an operating activity of the base unit and/or the accessory device in dependence on the type of the connected accessory device, wherein the at least one accessory device has a configuration memory, in which configuration data for configuring the base unit and/or the accessory device for an operation of the cleaning system is stored, wherein the control device of the base unit is configured for storing the configuration data stored in the configuration memory of the accessory device centrally in the base memory, and wherein the control device is configured for accessing the configuration data stored in the base memory for an operation of the cleaning system and for adjusting the base unit and/or the accessory device based on the configuration data.

2. The cleaning system according to claim 1, wherein a configuration datum of the configuration data contains a configuration parameter for the base unit, as well as a configuration parameter for the accessory device.

3. The cleaning system according to claim 1, wherein the accessory device has an accessory control device, which is configured for detecting an accessory element that is connected to the accessory device and defines the type of the accessory device, as well as for transmitting configuration data corresponding to the type of the accessory device to the control device of the base unit or making this configuration data available in the configuration memory.

4. The cleaning system according to claim 1, wherein a configuration datum of the configuration data contains a configuration parameter that is selected from the group consisting of: suction power of a fan, power of a driving motor, rotational speed of a rotating surface treatment element, oscillation frequency of an oscillating surface treatment element, position of a flow control element, flow cross section of a flow channel, and discharge rate of a liquid application device.

5. The cleaning system according to claim 1, wherein the accessory device has a biunique identification code, wherein the detection device is configured for detecting the identification code and for transmitting the identification code to the control device of the base unit, and wherein the control device is configured for storing the configuration data together with the detected identification code in the base memory and/or for retrieving configuration data stored for the detected identification code in the base memory.

6. The cleaning system according to claim 1, wherein the base memory contains a plurality of configuration tables that have a priority sequence for the configuration of the cleaning system, wherein the control device is configured for initially searching for a configuration datum in a configuration table with the highest order of priority and, in case no configuration datum is entered therein, for searching for a configuration datum in one or more configuration tables with comparatively lower order of priority in descending priority sequence.

7. The cleaning system according to claim 6, wherein the configuration tables are with respect to a descending priority sequence selected from the group consisting of: a temporary table containing configuration data that is stored in a volatile manner and read out of the configuration memory of the accessory device by the control device, wherein said configuration data is deleted when the base unit is switched off; an individual table containing configuration data specified by a user; an update table containing configuration data that is stored in a non-volatile manner and read out of the configuration memory of the accessory device by the control device, wherein said configuration data remains stored when the base unit is switched off; and a default table that is already stored in the base memory in a delivery state of the base unit by the manufacturer.

8. The cleaning system according to claim 6, wherein the control device is configured for detecting a target memory location for storing a configuration datum based on a priority code of the configuration datum and for carrying out a corresponding allocation to a configuration table defined by the priority code.

9. The cleaning system according to claim 1, wherein the base unit has a communication interface, which enables a user to access the base memory using an application installed on an external terminal in order to supplement and/or delete and/or change configuration data of the base unit and/or the accessory device.

10. The cleaning system according to claim 1, wherein, in a delivery state of the base unit by the manufacturer, the base memory of the base unit contains only configuration data for an operation of the base unit without a connected accessory device or wherein the base memory of the base unit contains in a delivery state of the base unit by the manufacturer only configuration data for an operation of the base unit without a connected accessory device and configuration data for at least one already known combination of the base unit and a certain accessory device.

11. The cleaning system according to claim 1, wherein the control device of the base unit is configured for transmitting configuration data for configuring the accessory device, which was read out of the configuration memory of the accessory device, to a separate accessory control device of the accessory device, wherein the accessory control device is designed for subsequently adjusting the control device itself based on the configuration data received from the base unit.

* * * * *